US008792796B2

(12) United States Patent
Kella et al.

(10) Patent No.: US 8,792,796 B2
(45) Date of Patent: Jul. 29, 2014

(54) DEVELOPMENT MONITORING METHOD AND SYSTEM

(75) Inventors: Dror Kella, Nes Ziona (IL); Shaul Raz, Shimsit (IL); Sasi Moalem, Holon (IL); Eyal Shelef, Tel Aviv (IL); Gal Amit, Even-Yehuda (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 879 days.

(21) Appl. No.: 12/598,034

(22) PCT Filed: Apr. 30, 2007

(86) PCT No.: PCT/US2007/010430

§ 371 (c)(1),
(2), (4) Date: Apr. 23, 2010

(87) PCT Pub. No.: WO2008/133631

PCT Pub. Date: Nov. 6, 2008

(65) Prior Publication Data

US 2010/0296825 A1 Nov. 25, 2010

(51) Int. Cl.
*G03G 15/10* (2006.01)

(52) U.S. Cl.
USPC ..... 399/59; 399/24; 399/237

(58) Field of Classification Search
USPC ..... 399/24–27, 31, 53, 59, 236–241
See application file for complete search history.

(56) References Cited

U.S. PATENT DOCUMENTS

| | | | | |
|---|---|---|---|---|
| 5,724,629 | A | 3/1998 | Iino et al. | |
| 2003/0016962 | A1 * | 1/2003 | Teraoka et al. | 399/57 |
| 2004/0184829 | A1 | 9/2004 | Shin et al. | |

FOREIGN PATENT DOCUMENTS

JP 2006154541 A 6/2006

OTHER PUBLICATIONS

PCT international search report and written opinion in parent PCT patent application PCT/US2007/010430, Mar. 26, 2008.

* cited by examiner

*Primary Examiner* — Walter L Lindsay, Jr.
*Assistant Examiner* — Jessica L Eley

(57) ABSTRACT

A method for monitoring development parameters of a liquid toner electrophotographic (LEP) printer, the method comprising defining an operational window for a current utilized by the printer and monitoring the current to determine a deviation of the current outside the operational window.

14 Claims, 8 Drawing Sheets

DEVELOPMENT MONITORING METHOD AND SYSTEM

FIELD OF THE INVENTION

The present invention relates to on-line control of xerographic printing parameters.

BACKGROUND OF THE INVENTION

The usage of charged toner particles in a carrier liquid (hereinafter "liquid toner") for Liquid Toner Electrophotography (LEP) includes the development of ink between conductive elements under the influence of electric fields. Known Binary Ink Development (BID) units use a developer cylinder with a coating of high concentration of liquid toner to transfer toner particles onto a photoconductive surface. When the surface of the developer bearing the layer of liquid toner concentrate is engaged with the photoconductive surface of the drum, the difference in voltages between the developer cylinder and the photoconductive surface allows for selective transfer of the layer of toner particles to the photoconductive surface thereby developing the latent image. It has been shown that liquid toner having elongate fibrous extensions (hereinafter "ElectroInk") produces superior results. Other methods of LEP, such as electrophoretic development are also well known.

Known methods of stabilization of the charging component of the liquid toner, e.g. the charge director of toner, include adding charge director based on sensor readings sensing the low field conductivity between two plates immersed in a tank of liquid toner. The sensor operation may be degraded over time by toner contamination and electronic drift. In addition the sensitivity of the toner to the charge director content may alter over time and/or with the amount of charge director added to the tank. In some examples, specific toner may charge up while printing, faster than the charging component may be depleted.

Some known toners do not have a trivial indication to the charging component concentration. For example, for some known toners, the conductivity may be so low that a low field conductivity measurement may be noisy or unreliable. As a result these toners may be excluded from use in LEP.

Off-line calibration of the BID parameters may typically be performed on a periodic basis based on a predetermined number of impressions or by visual observation of degradation in the quality of the print. Typically calibration is performed by printing samples in an iterative method where voltage values utilized in image generation and development are changed until the correct optical density of a printed patch is obtained. Since this requires printing, the user must stop printing his jobs and employ the press with this calibration procedure. This may impose an undesired expense and inconvenience to the user both due to wasteful printing and to loss of printing time.

U.S. Pat. No. 5,436,706 entitled "Latent Image Development Apparatus", the contents of which is fully incorporated herein by reference describes an imaging apparatus for the development of latent images in electro-photographic imaging systems by the direct transfer of concentrated liquid toner (BID). The imaging apparatus includes apparatus for supplying liquid toner to the surface of a developer roller, forming a thin layer of liquid toner containing a relatively high concentration of charged toner particles on the surface. The coated roller is used to develop a latent image by the selective transfer of portions of the layer of concentrated liquid toner to a surface containing the latent image.

U.S. Pat. No. 5,610,694 entitled "Latent Image Development Apparatus", the contents of which is fully incorporated herein by reference describes an imaging apparatus for the development of latent images in electro-photographic imaging systems by transfer of concentrated liquid toner, similar to that of the previous reference, wherein the optical density of toner in the toned regions of the final image is substantially uniform. In imaging apparatus, the developer voltage is selected to enable transfer of only a portion of the layer thickness to the image areas of the latent image. The inventor found that when the developer voltage is properly chosen, the non-uniformity of the layer transferred to the image forming surface is improved at least by a factor of two.

U.S. Pat. No. 5,737,666 entitled "Development Control System", the contents of which is fully incorporated herein by reference describes a liquid toner system. The toner system includes a developed mass per unit area (DMA) controller unit having an input for receiving an indication of the DMA on the image surface such as the photoconductor, and adjusting the DMA on the toning surface in response to the received input, whereby the DMA on the toner roller is maintained substantially constant.

U.S. Pat. No. 7,088,932 entitled "System and method for measuring charge/mass and liquid toner conductivity contemporaneously", the contents of which is fully incorporated herein by reference describes a method to measure the conductivity of a liquid or paste electro-photographic toner by providing two parallel plane conductive plates with a uniform separation between the plates to form a space between the plates; filling the space between the plates with liquid or paste electro-photographic toner; applying an alternating current voltage of at least 100V between the plates across the liquid or paste toner; measuring as data the current passing through an external component into the plates; adjusting the data to remove current contributions attributable to impurity ions; sending adjusted data to a processor; and determining the conductivity of the toner from the adjusted data.

PCT Patent Application Publication No. WO2006090352 entitled "Reverse Flow Binary Image Development", the contents of which is fully incorporated herein by reference describes a binary image development printing system using liquid toner where most of the liquid toner flows along the surface of the developer cylinder, in the gap between the electrode and the developer cylinder, in a direction opposite to the direction of rotation of the cylinder. Using this system, a larger fraction of the toner particles may adhere to the developer cylinder than in conventional binary image development systems, in which most of the liquid toner flows in the same direction as the developer cylinder.

SUMMARY OF THE INVENTION

An aspect of some embodiments of the invention is the provision of a system and method for stabilization of charge density of ink in a print engine, e.g. a BID print engine, based on measured currents between various elements of the print engine. The current that develops in these elements and other conductive elements of a printer may be dependent on charging of the electro-ink, thickness of the electro-ink layer and in some cases mobility of the electro-ink. According to some embodiments of the present invention, BID currents may be directly related to charge density in the ink during printing. Variation of the charge density requires changes of the printing parameters in order to stabilize the final printed outcome. Using predefined correlations the stabilization may be done on-the-fly, i.e., during printing, by change of one or some of the printing parameters, e.g., electrode voltage and developer voltage. Current monitoring and BID parameter adjustment may eliminate the need for off-line calibration and/or may increase the number of printed pages between paper calibrations, e.g. off-line calibrations.

According to embodiments of the present invention, BID currents may be measured during an off-line calibration procedure and gradients of parameters including optical density (OD), developer voltage (Vdev), and/or electrode voltage (Velec) for the measured BID currents may be extracted. BID currents may include electrode current, developer current, squeegee roller current, cleaning cylinder current, and/or or any other element which may have electrical interaction with the ink in the development stage. Gradient measurements may be stored. Based on the extracted gradients, a desired range of currents may be defined. During printing, BID currents may be monitored and deviation in the currents beyond the defined range may be detected.

In one embodiment of the present invention, charge director may be automatically added to the ink tank to compensate for a deviation of a desired current below a defined range and/or window. Alternatively, indication may be given to a user to perform off-line calibration to compensate for a deviation of a desired current above or below a defined window.

In another embodiment of the present invention, developer and electrode voltage may be adjusted to correct for a deviation in the desired current. For example, developer and/or electrode voltage may be adjusted, on-the-fly, e.g. during the printing process. Adjustment to the developer and electrode voltage may be based on the gradient measurements extracted during a previous off-line calibration procedure. In one embodiment, adjustment to the developer and/or electrode voltage may be performed when addition of charging component is not effective, for example addition of charging component to the toner may not compensate fast enough or at all for monitored changes in the current.

In yet another embodiment of the present invention, adjustment to other electrical parameters in the print engine may be initiated on-the-fly and/or during off-line calibration when current monitoring indicates a fluctuation in one or more BID currents beyond a defined window.

In one embodiment of the present invention, on-the-fly adjustment to the developer and/or electrode voltage may be restricted to a predetermined threshold. For a required adjustment above the predetermined threshold, the user may receive an indication to perform off-line calibration.

In yet another embodiment of the present invention, BID currents may be measured after an off-line calibration procedure is performed. BID currents may be monitored during printing and a deviation above a predefined threshold for each of the currents measured may be recorded. Indication to perform an additional off-line calibration may be given to a user when one or more of the currents, e.g. all the measured currents, deviate beyond the predetermined threshold. Indication that the off-line calibration should not be performed may be given to a user, if the one or more defined currents did not deviate beyond the defined threshold.

Embodiments of the present invention, using print engine currents measurements to stabilize charge density may facilitate working with toners that may not have sufficiently measurable low-field conductivity and/or with toners that may have a temporally changing sensitivity to charge director component and to development potential parameters.

An aspect of other embodiments of the present invention provides a system and method of indicating to a user when an off-line calibration is to be performed based on print engine current measurements. BID currents may include electrode current, developer current, squeegee roller current and/or cleaning cylinder current, and/or or any other element which may have electrical interaction with the ink in the development stage. Off-line calibration indication may facilitate maintaining a desired print quality as well and may saving time and money by avoiding wasteful off-line calibration.

An aspect of some embodiments of the invention provides a method for monitoring development parameters of a LEP printer, the method comprising defining an operational window for a current utilized by elements of the printer; and monitoring the current to determine a deviation of the current outside the operational window.

Optionally, the LEP printer includes a Binary Ink Development (BID) unit comprises one or more of a developer cylinder charged at a voltage operative to develop a latent image on a photoconductor of the printer, an electrode charged at a voltage operative to coat the developer cylinder with toner, a squeegee roller charged at a voltage operative to urge toner particles toward the charged developer cylinder, and a cleaning cylinder charged at a voltage operative to clean off charged toner from the developer cylinder.

Optionally, the current is a current drawn from the electrode.

Optionally, the current is a current drawn from the developer cylinder.

Optionally, the current is a current drawn from the squeegee roller.

Optionally, the current is a current drawn from the cleaning cylinder.

Optionally, the current is a current drawn from the element of the printer that is in electrical contact with the toner.

Optionally, the method additionally comprises adding charge director to the toner when the deviation of the current outside the operational window is determined to exist.

Optionally, the method additionally comprises adjusting a development parameter on-the-fly when the deviation of the current outside the operational window is determined to exist.

Optionally, the development parameter is charge director.

Optionally, the parameter is an electrode voltage.

Optionally, the parameter is a laser writing power.

Optionally, the parameter is developer voltage.

Optionally, the method additionally comprises suggesting calibration when a deviation of the current outside the operational window is determined to exist.

Optionally, the method additionally comprises defining a relationship between the current and a gradient of a parameter of the printer.

Optionally, the defining is during an off-line calibration procedure.

Optionally, the method additionally comprises stabilizing the parameter based on the relationship defined.

Optionally, the method additionally comprises determining an optical density of a print.

Optionally, the method additionally comprises adjusting a parameter of the printer when the optical density is outside a defined threshold.

Optionally, adjustment level is based on the deviation of the current outside the operational window.

An aspect of some embodiments of the invention provides a system for controlling development parameters of a xerographic printer comprising a Binary Ink Development (BID) unit comprising one or more of a developer cylinder charged at a voltage operative to develop a latent image on a photoconductor of the printer, an electrode charged at a voltage operative to coat the developer cylinder with toner, a squeegee roller charged at a voltage operative to urge toner particles toward the charged developer cylinder, and a cleaning cylinder charged at a voltage operative to clean off charged toner from the developer cylinder, a current sensor to sense a BID current, a memory unit to store a desired working current, and a controller adapted to control a parameter of the printer in response to a deviation in the sensed BID current.

Optionally, the current sensor senses the current at the developer cylinder.

Optionally, the current sensor senses the current at the electrode.

Optionally, the current sensor senses the current at the squeegee roller.

Optionally, the current sensor senses the current at the cleaning cylinder.

Optionally, the controller is operative to control addition of charge director in response to a change in the sensed BID current.

Optionally, the controller is operative to control a voltage level of the developer cylinder.

Optionally, the controller is operative to control a laser writing power level.

Optionally, the controller is operative to control the parameter on-the-fly.

Optionally, the controller is operative to control display of a message to calibrate the printer.

Optionally, the system additionally comprises an optical densitometer to sense the optical density of a print.

Optionally, the memory unit is operative to store a relationship between the BID current and a gradient of the parameter.

Optionally, the controller is operative to stabilize the development parameters based on the measured BID current.

Optionally, the memory unit is operative to store a relationship between the BID current and a printed output parameter.

Optionally, the current sensor is operative to sense a current of an element in electrical contact with the toner during development.

BRIEF DESCRIPTION OF THE DRAWINGS

The subject matter regarded is particularly and distinctly claimed in the concluding portion of the specification. The invention, however, may be understood by reference to the following detailed description of non-limiting exemplary embodiments, when read with the accompanying drawings in which:

Figure 1:
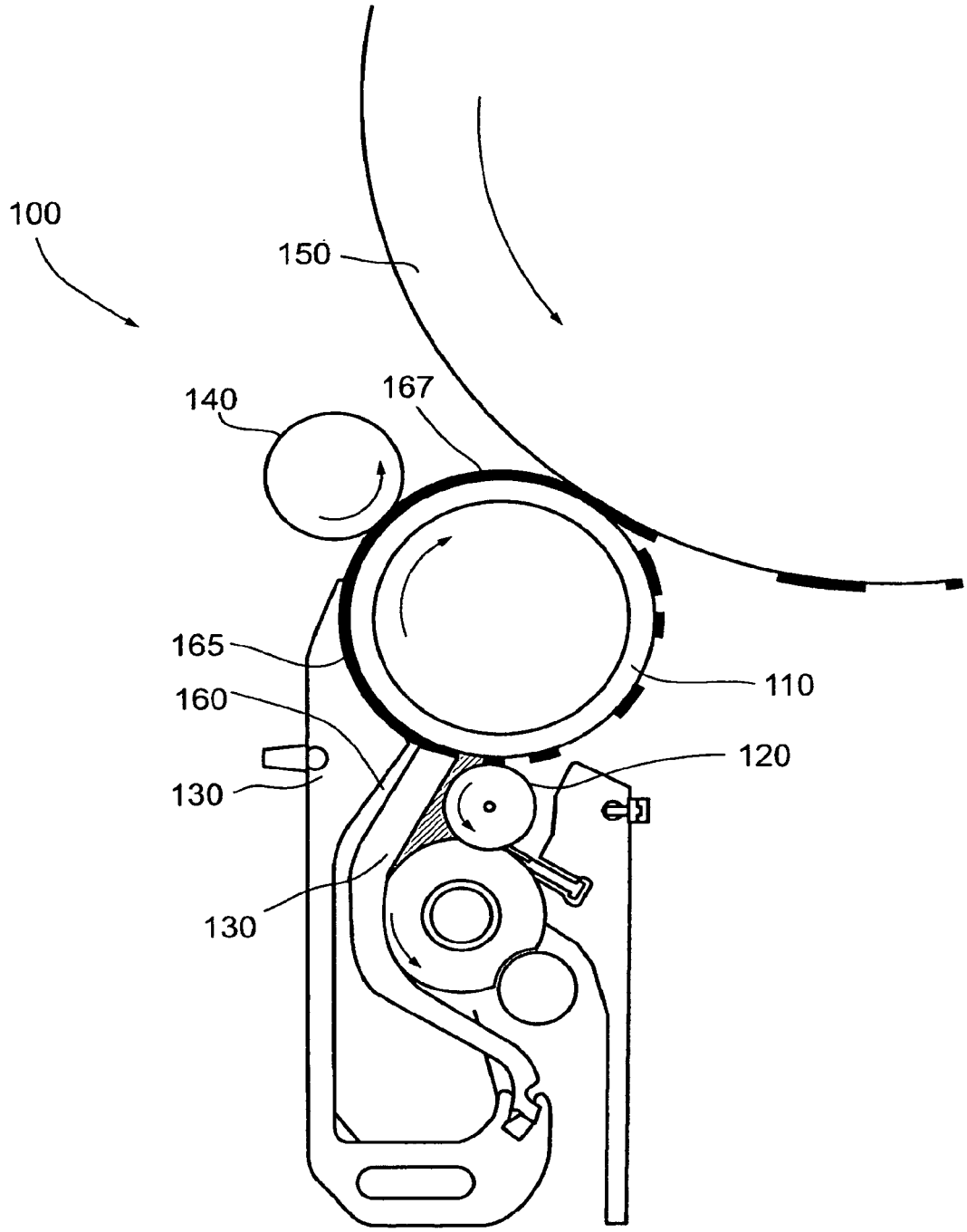
FIG. 1 is schematic diagram of a print engine incorporating a known BID unit.

It, will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following description, exemplary embodiments of the invention incorporating various aspects of the present invention are described. For purposes of explanation, specific configurations and details are set forth in order to provide a thorough understanding of the embodiments. However, it will also be apparent to one skilled in the art that the present invention may be practiced without all the specific details presented herein. Furthermore, well-known features may be omitted or simplified in order not to obscure the present invention. Features shown in one embodiment may be combinable with features shown in other embodiments, even when not specifically stated. Such features are not repeated for clarity of presentation. Furthermore, some unessential features are described in some embodiments.

Reference is now made to FIG. 1 showing a schematic diagram of a known BID unit. BID unit 100 includes a developer cylinder 110, one or more electrodes 130, an optional squeegee roller 140 and a cleaning cylinder 120. A photoconductor 150 may include charged and discharged areas that define an image. Developer cylinder 110 may be charged to a voltage which is intermediate the voltage of the charged and discharged areas on photoconductor surface 150. Liquid toner flows through ink channel 160 to a space between charged developer cylinder 110 and charged electrode 130 whereby the toner particles are deposited on developer cylinder 110 as a layer of concentrated toner 165. Squeegee roller 140, preferably electrified, applies pressure on the developer cylinder 110 squeezing excess liquid out of the toner layer 165 on the surface of developer cylinder 110, further concentrating toner layer 165.

Developer cylinder 110 bearing the layer of liquid toner concentrate engages photoconductor 150. The difference in potential between developer cylinder 110 and photoconductor 150 causes selective transfer of the layer of toner particles to the photoconductor, thereby developing the latent image. Depending on the choice of toner charge polarity and the use of a "write-white" or "write-black" system as known in the art, the layer of toner particles will be selectively attracted to either the charged or discharged areas of the photoconductor, and the remaining portions of the toner layer will continue to adhere to developer cylinder 110. Cleaning cylinder 120 is optionally charged with a voltage potential to strip the ink from the developer cylinder and wrap it on the cleaning cylinder. Other methods of removing the untransferred toner may be used. The discharging of the ink when transferred on the cleaning cylinder initiates a current flow that may be measured on the power supply used to charge the cleaning cylinder at the specified voltage potential.

Figure 2:
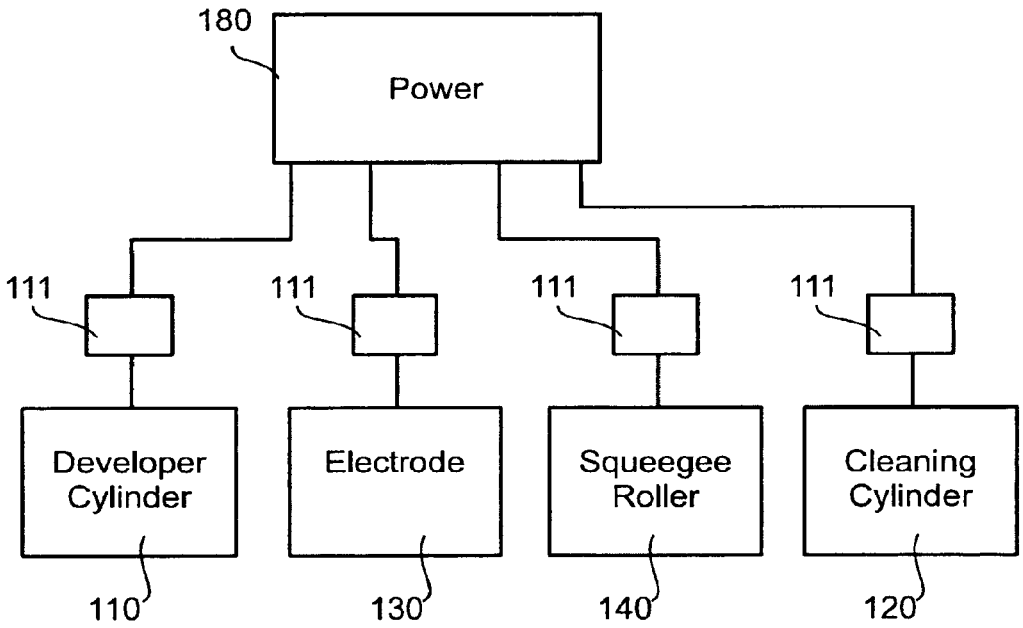
FIG. 2 is a schematic block diagram of a power system including current sensors monitoring the current drawn from a power supply by components of a BID according to an embodiment of the present invention.

Reference is now made to FIG. 2 showing a block diagram of a power system including current sensors monitoring the current drawn from a power supply by components of a BID according to an embodiment of the present invention. One or more power supplies 180 may be used to charge the components of the BID unit such as developer cylinder 110, electrode 130, squeegee roller 140 and cleaning cylinder 120, at a desired voltage. The current drawn by each of these components may be monitored by a current sensor 111 on their respective power supply and/or power supply channels. By correlating the currents measured on the power supplies of these units with the control values of the toner and development, it is possible to monitor and control the ink electrical parameters. According to some embodiments of the present invention, monitoring the ink electrical parameters may be used to determine when to add ink charging components, e.g. charge director to the ink supply and/or when to provide indication to adjust one or more electric element parameters, e.g. developer voltage, electrode voltage, etc. In other embodiments, current monitoring may be used to adjust and/or determine a need for adjustment of electric elements other than those found in the BID unit, e.g. laser writing voltage or other electric elements.

Figure 3:
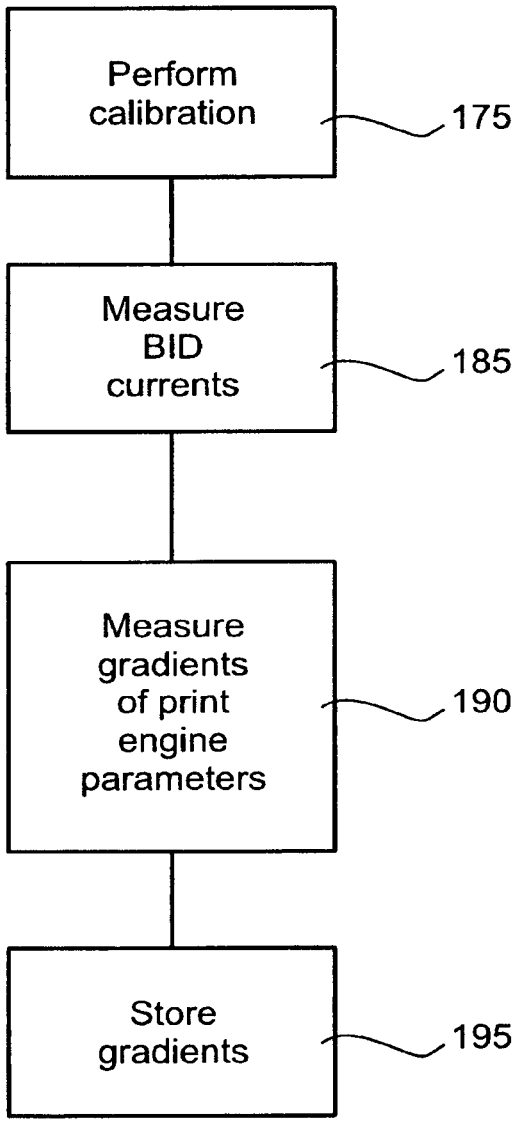
FIG. 3 is a flow chart describing an exemplary method for determining gradients of print engine parameters for measured BID currents, according to an embodiment of the present invention.

Reference is now made to FIG. 3 showing a flow chart describing an exemplary method for determining gradients of print engine parameters for measured BID currents according to an embodiment of the present invention. According to some embodiments of the present invention, a calibration may be performed (block 175), e.g. an off-line calibration and BID currents may be measured during the calibration procedure (block 185). Gradients of parameters and/or printed output parameter including optical density (OD), ink charging, developer voltage (Vdev), and/or electrode voltage (Velec) for the measured BID currents may be extracted (block 190) during the calibration procedure. BID currents may include electrode current, developer current, squeegee roller current and/or cleaning cylinder current. Gradient measurements may be stored (block 195). Based on the extracted gradients and based on measurements of the optical properties of the resulting image at these values, a desired range of currents may be defined. During printing, BID currents may be monitored and deviation in the currents beyond the defined range may be detected. According to other embodiments of the present invention, BID currents may be measured during an off-line calibration procedure and gradients of parameters other than BID parameters, e.g. laser writing power, photoconductor charger voltage etc., may be extracted.

Figure 4:
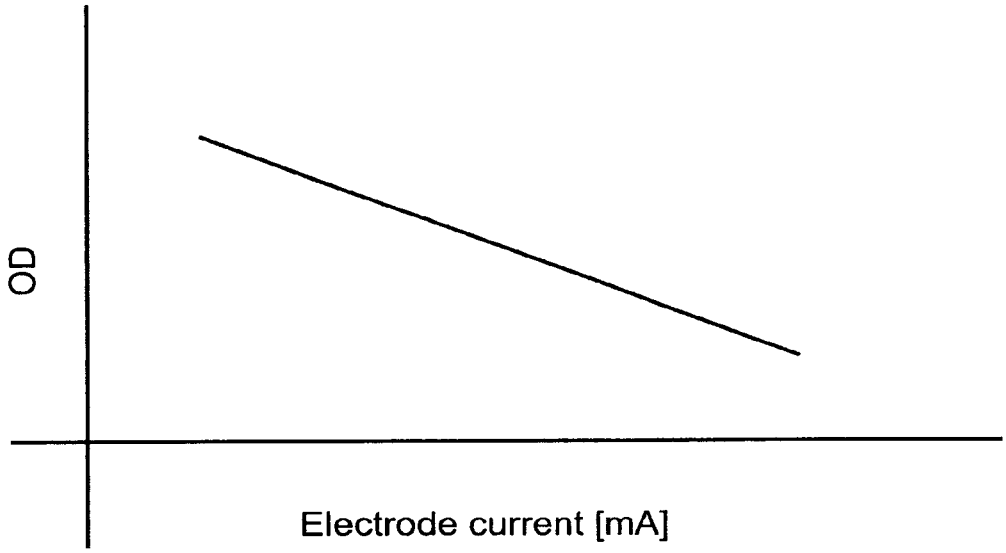
FIG. 4 is an exemplary graph showing a relationship between electrode current and optical density at constant bid voltages, according to an embodiment of the present invention.

Reference is now made to FIG. 4 which is a relationship between electrode current and optical density with constant BID voltages according to an embodiment of the present invention. According to some embodiments of the present invention, optical density of a print may be sensed by one or more optical densitometers. The relationship between electrode current and optical density may be established. Typically, for constant BID voltages, the optical density may decrease with an increase in electrode current. For example, for constant BID voltages, a change in electrode current may reflect a change in the toner. For example, the developer voltages may be set to transfer a given amount of charge. An increase in charging of the toner, will reflect in an increase in electrode current and may reduce the transferred ink layer thickness and therefore the optical density. In some examples, the optical density may decrease in an approximately linear fashion as the electrode current increases. In other embodiments, the relationship between electrode current and/or other BID current may be approximated as a non-linear function. According to embodiments of the present invention, ink layered thickness may be also monitored, for example, to monitor stability in the ink thickness.

According to some embodiments of the present invention, optical density may be stabilized by monitoring electrode current during printing. A pre-defined window of electrode currents may be defined that correspond to a desired optical density. According to one embodiment of the present invention, one or more parameters may be adjusted on-the-fly if the current level corresponding to the desired optical density falls outside the predetermined window. For example, a parameter defining the amount of toner charging component to add to the toner may be adjusted. In other examples more than one parameter may be adjusted. According to other embodiments of the present invention a suggestion to perform an off-line calibration may be indicated if the current level corresponding to the desired optical density falls outside the predetermined window.

Correlation between other BID unit currents and optical density may be established, e.g. squeegee roller current or cleaning cylinder current. One or more BID unit currents may be monitored and utilized for stabilizing output parameters such as printed optical density.

Electrode current may typically have a stronger signal with a higher signal to noise ratio (SNR) as compared to the squeegee roller and cleaning cylinder current. However, there may be resistance that may develop in the ink and developer that may need to be accounted for. In addition since the voltage is typically not maintained constant in the electrode, voltage levels may be monitored so that currents may be measured at constant and stable voltage levels.

According to some embodiments of the present invention cleaning cylinder current may be monitored. Cleaning cylinder current may be indicative of the charge at BID disengage. Measurement may be performed during disengage, e.g. while the BID unit is disconnected from printing, or when printing a known pattern. This may be especially convenient during color printing when one BID unit is engaged at a time while the others may be disengaged. For example when one unit is being used, the developer of another unit that is disengaged may be coated with toner. In this case, the cleaning roller is not affected by the developer process and stable current measurements may be taken.

Squeegee roller currents may be similar to currents measured on the electrode but with lower amplitude. Alterations in the pressure imposed by the squeegee roller may need to be taken into account to obtain stable current measurements. In addition due to the high electric field any glitch, e.g. minor change in the toner may appear as spikes in the current reading.

Figure 5:
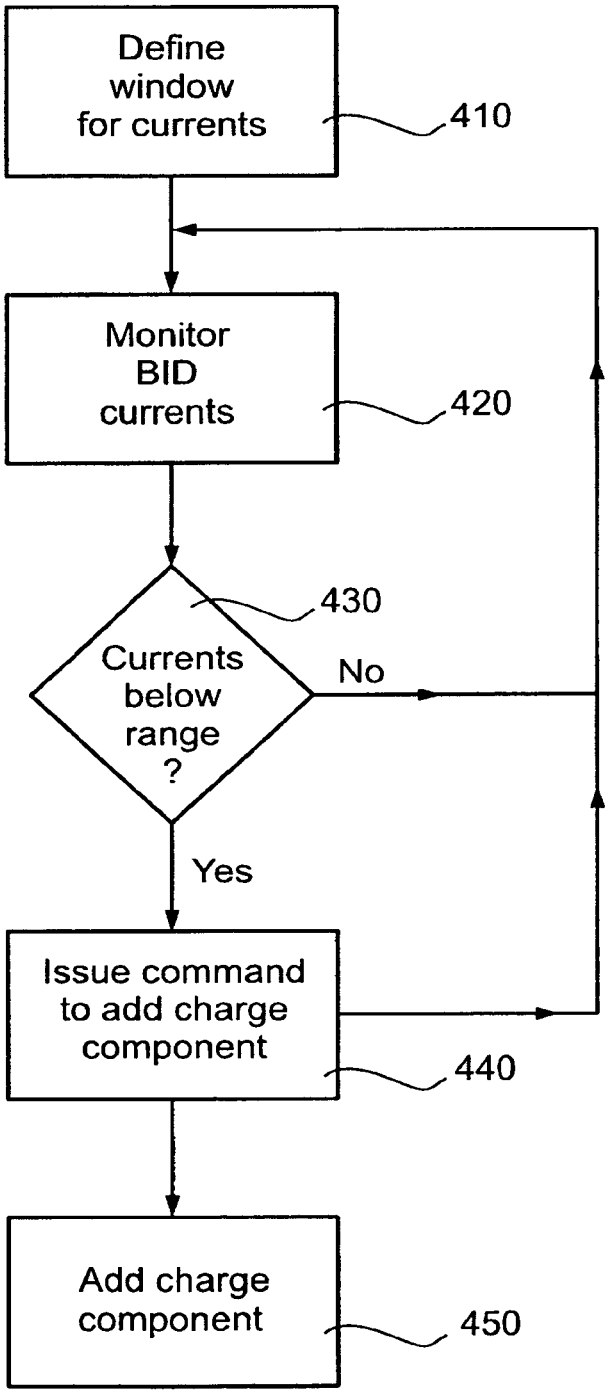
FIG. 5 is a flow chart describing an exemplary method of controlling ink electrical parameters on-the-fly by monitoring current levels in a BID unit, according to one embodiment of the present invention.

Reference is now made to FIG. 5 showing a flow chart describing a method for controlling ink electrical parameters on-the-fly by monitoring current levels in a BID unit according to one embodiment of the present invention. According to some embodiments of the present invention, an operational current window for one or more BID currents may be defined (block 410). The current windows may be defined based on pre-determined measured relationship between current and gradient ink charging. During printing, one or more BID currents may be monitored (block 420). If one or more currents fall below the defined window (block 430), a command to add charge component e.g. charge director, to the ink tank may be issued (block 440).

According to one embodiment of the present invention, the command may specify a specific amount of charge director to be added related to a decrease in BID current level measured, e.g. BID electrode current level measured. According to another embodiment of the present invention, a predetermined amount of charge director may be added for each command issued and stabilization of the ink charge may be established by an iterative approach. Charge director may be added to the ink tank (block 450) on-the-fly, e.g. during the printing process and/or in between printing. In one example, if more than a defined number of iterations are attempted to stabilize the current, a suggestion to perform a full calibration may be established.

According to another embodiment of the present invention, the command to add charge director may include specification of the amount of charge director to add based on the measured current gradient, e.g. the deviation in current beyond the defined window. In other embodiments more than one BID current may be monitored and charge director may be added to the toner tank when all and/or more than one BID current falls out of the specified range. In yet other embodiments, more than one BID current is measured, and charge director is be added to the ink tank when any one of the monitored BID current falls out of the specified range. In some embodiments of the present invention, parameters other than charging component may be adjusted and/or parameters in addition to charge director may be adjusted, e.g. developer voltage, electrode voltage, etc.

Figure 6:
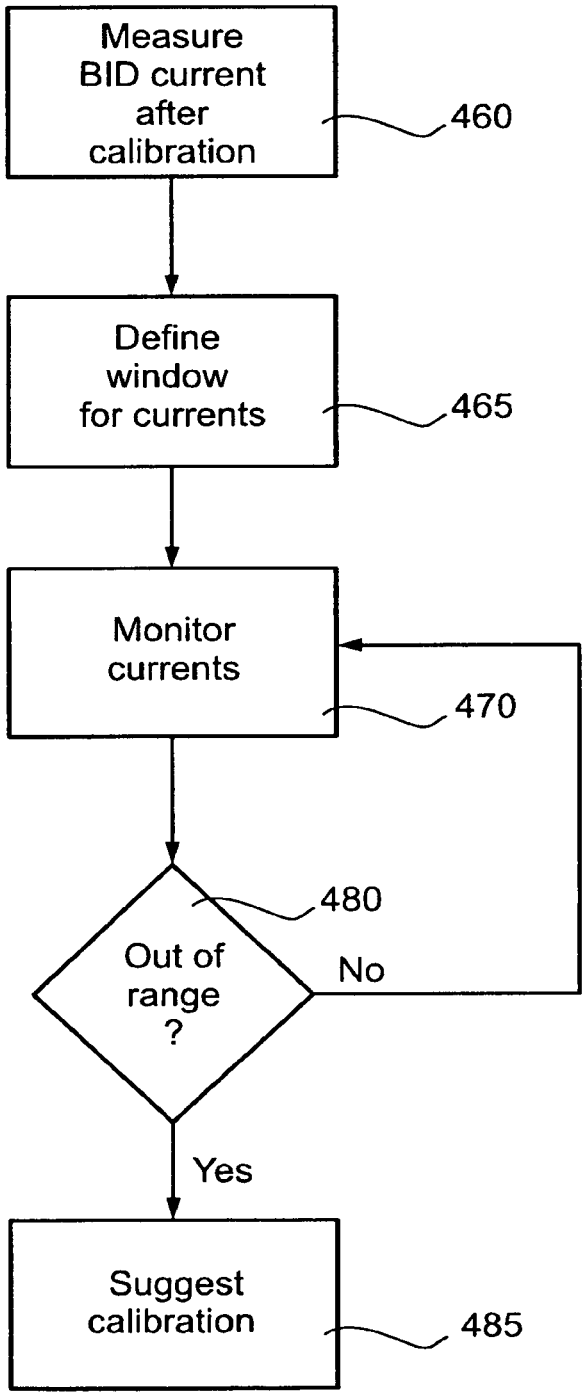
FIG. 6 is a flow chart describing an exemplary method for determining a need for off-line calibration based on BID current monitoring, according to an embodiment of the present invention.

Reference is now made to FIG. 6, showing an exemplary method for determining a need for off-line calibration based on BID current monitoring according to an embodiment of the present invention. According to some embodiments of the present invention, one or more operational BID current levels may be measured after an off-line calibration procedure (block 460). The measured current levels after a calibration procedure may be considered the preferred current levels and/or the substantially optimal current levels. According to this embodiment of the present invention, gradients of print engine parameters may not be measured. A window around the measured current levels may be defined, defining for example a percent deviation in desired current level that may be tolerated (block 465). During printing and/or between printing jobs, the BID currents may be monitored (block 470). Detection if the monitored current fell out of the desired range may be detected (block 480). If one or more the monitored currents fell out of the desired range, a suggestion to perform a calibration procedure, e.g. an off-line calibration procedure, may be indicated to a user (block 485).

Figure 7:
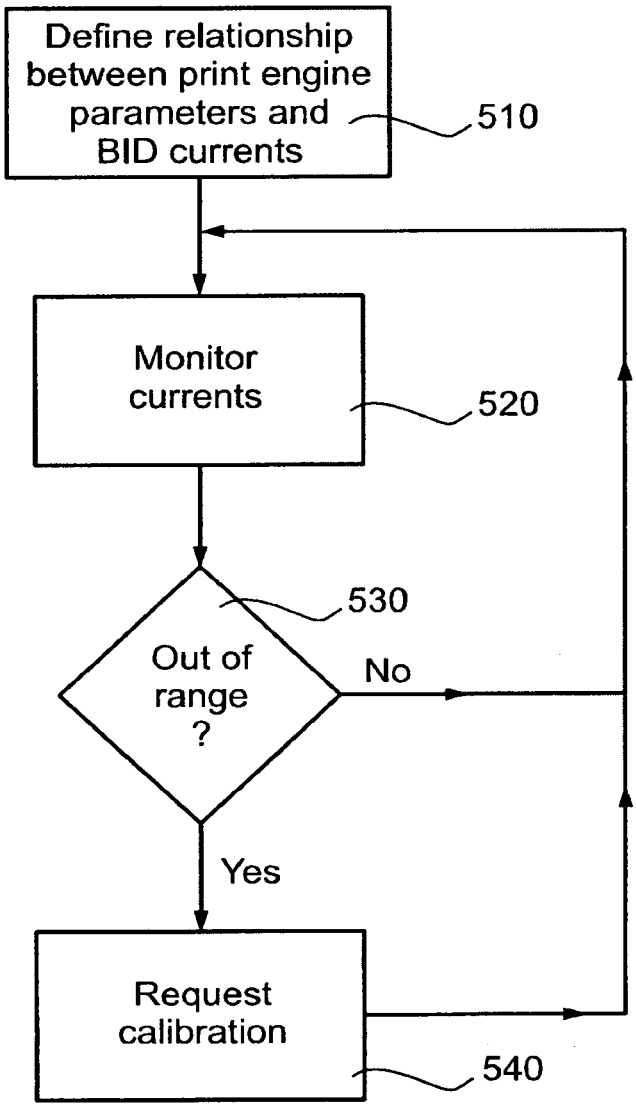
FIG. 7 is a flow chart describing an exemplary method for determining a need for off-line calibration based on BID current monitoring, according to another embodiment of the present invention.

Reference is now made to FIG. 7 chart describing an exemplary method for determining a need for off-line calibration by monitoring BID currents according to an embodiment of the present invention. According to one embodiment of the present invention, relationships between gradients of one or more print engine parameters and BID currents may be defined, for example during an off-line calibration procedure (block 510). The specified BID currents may be monitored during the printing process (block 520) to determine stability of specified measured print engine parameters according to the relationships defined. A change in the value of one or more of the measured print engine parameters, e.g. a pre-defined percent change, may be detected (block 530). The value of the measured print engine parameters may be determined from the defined relationship between the print engine parameters and the monitored currents of the BID unit. If one or more print engine parameters deviate from a desired value by a defined amount, a suggestion to calibrate the printer may be indicated to the user (block 540). According to one embodiment of the present invention, the value of the print engine parameters may be determined based the pre-established relationship between BID currents and the print engine parameters. One or more BID monitored currents may be used to estimate changes in the value of print engine parameters. According to one or more embodiments of the present invention the urgency for the calibration may be indicated and may be related to the degree in which the values of the print engine parameters deviated from the desired value.

Figure 8:
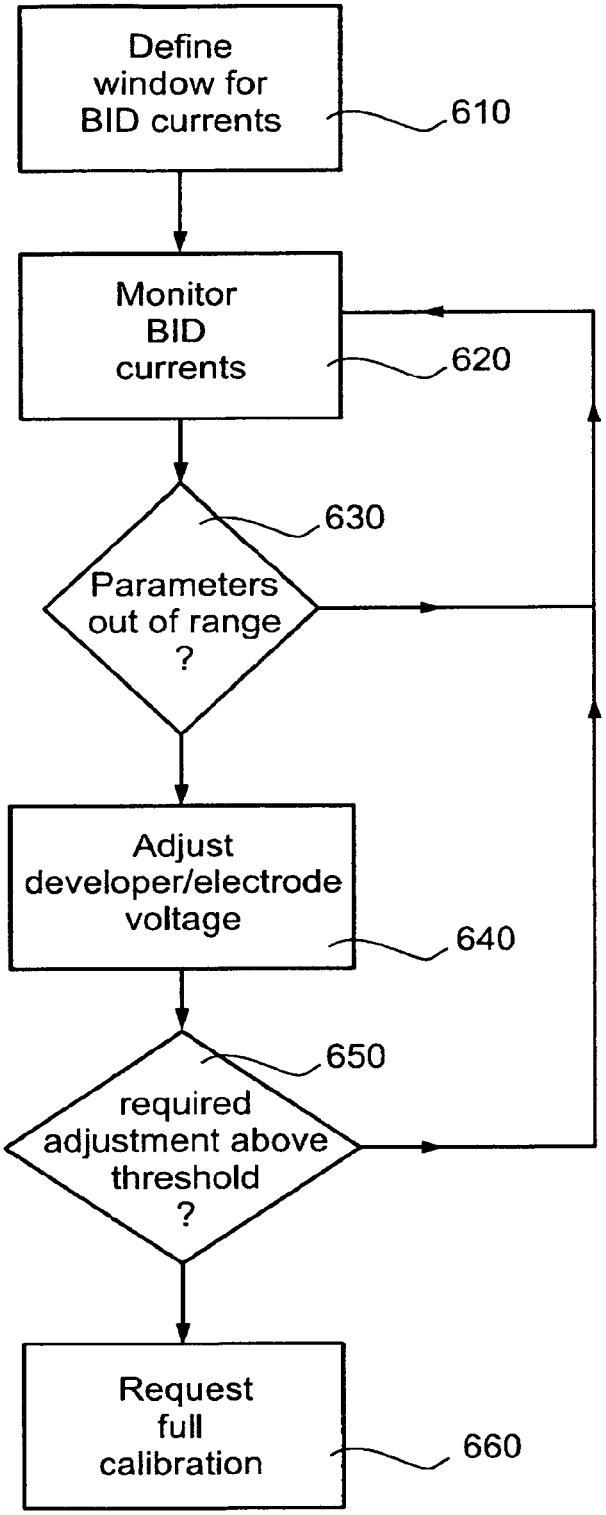
FIG. 8 is a flow chart describing an exemplary method for stabilizing printer electrical parameters by monitoring BID currents, according to an embodiment of the present invention.

Reference is now made to FIG. 8 showing flow chart describing a sample method for stabilizing printer electrical parameters by monitoring BID currents according to some embodiments of the present invention. According to one embodiment of the present invention, a relationship between one or more BID currents and one or more electrical parameters of the printer may be defined. For example, a relationship between BID currents and developer voltage may be defined. In other examples other relationships may be established. For example a relationship between other voltage levels in the printer, e.g. electrode voltage, and BID currents and BID currents may be defined. In other example a relationship between laser writing power and BID currents may be defined. In yet other examples, a relationship between measured optical density and BID currents may be defined. More than one relationship may be defined.

An operational window may be defined for one or more BID currents according to a relationship defined, e.g. the relationship between developer voltage level and BID currents (block 610). One or more BID currents may be monitored (block 620) to determine stability of the defined electrical parameter, e.g. to determine stability of developer voltage. A change in one or more of the BID currents beyond the operational window may be detected (block 630). An adjustment to the corresponding electrical parameter, e.g. developer voltage may be made on-the-fly by pre-determined amount in an iterative process and/or defined specifically based on the measured value of the currents (block 640). On-the-fly adjustment to the developer voltage may be limited to a per-defined amount. A need to adjust the developer voltage above the defined amount and/or threshold may be determined (block 650). For adjustments above a pre-defined level a suggestion to calibrate, e.g. calibrate by off-line calibration, may be indicated to the user (block 660).

Relationship between BID currents and ink charge and/or optical density may be established by comparing potentials applied on elements with printed samples, measuring currents during calibration and extracting gradients, e.g. change in optical density, developer voltages, electrode voltages, ink charge versus all the currents. The established relationships may be saved and BID currents may be monitored to determine a corresponding change in one or more of the printer parameters. A detected change in one or more of the BID currents may prompt adjustment to one or more printer measurable parameters.

It should be further understood that the individual features described hereinabove can be combined in all possible combinations and sub-combinations to produce exemplary embodiments of the invention. The examples given above are exemplary in nature and are not intended to limit the scope of the invention which is defined solely by the following claims.

The terms "include", "comprise" and "have" and their conjugates as used herein mean "including but not necessarily limited to".

The invention claimed is:

1. A method for monitoring development parameters of a LEP printer, the method comprising:

defining an operational window for a current utilized by an element of the printer;

monitoring the current to determine a deviation of the current outside the operational window;

in response to determining that the deviation of the current outside the operational window by less than a predetermined threshold, automatically adding charge director to the printer on-the-fly; and in response to determining that the deviation of the current is outside the operational window by greater than the predetermined threshold, notifying a user to manually perform offline calibration.

2. The method according to claim 1 wherein the LEP printer includes a Binary Ink Development (BID) unit comprising one or more of:

a developer cylinder charged at a voltage operative to develop a latent image on a photoconductor of the printer;

an electrode charged at a voltage operative to coat the developer cylinder with toner;

a squeegee roller charged at a voltage operative to urge toner particles toward the charged developer cylinder; and a cleaning cylinder charged at a voltage operative to clean off charged toner from the developer cylinder.

3. The method according to claim 2 wherein the current is either one of a current drawn from the electrode, a current drawn from the developer cylinder, a current drawn from the squeegee roller, a current drawn the cleaning cylinder, or a current drawn from the element of the printer that is in electrical contact with the toner.

4. The method according to claim 1 comprising adding charge director to the toner when the deviation of the current outside the operational window is determined to exist.

5. The method according to claim 1 comprising suggesting calibration when a deviation of the current outside the operational window is determined to exist.

6. The method according to claim 1 comprising defining a relationship between the current and a gradient of a parameter of the printer.

7. The method according to claim 1 comprising determining an optical density of a print.

8. A system for controlling development parameters of a xerographic printer comprising:

a Binary Ink Development (BID) unit comprising one or more of:

a developer cylinder charged at a voltage operative to develop a latent image on a photoconductor of the printer;

an electrode charged at a voltage operative to coat the developer cylinder with toner;

a squeegee roller charged at a voltage operative to urge toner particles toward the charged developer cylinder; and a cleaning cylinder charged at a voltage operative to clean off charged toner from the developer cylinder;

a current sensor to sense a BID current;

a memory unit to store a desired working current; and a controller adapted to, in response to determining that the current deviates outside an operational window by less than a predetermined threshold automatically add charge director to the printer, and in response to determining that the current devices outside the operational window by greater than the predetermined threshold notify a user to manually perform offline calibration.

9. The system according to claim 8 wherein the controller is operative to control addition of charge director in response to a change in the sensed BID current.

10. The system according to claim 8 comprising an optical densitometer to sense the optical density of a print.

11. The system according to claim 8 wherein the memory unit is operative to store a relationship between the BID current and a gradient of the parameter.

12. The system according to claim 8 wherein the controller is operative to stabilize the development parameters based on the measured BID current.

13. The system according to claim 8 wherein the memory unit is operative to store a relationship between the BID current and a printed output parameter.

14. The system according to claim 8 wherein the current sensor is operative to sense a current of an element in electrical contact with the toner during development.

* * * * *

UNITED STATES PATENT AND TRADEMARK OFFICE

CERTIFICATE OF CORRECTION

PATENT NO. : 8,792,796 B2
APPLICATION NO. : 12/598034
DATED : July 29, 2014
INVENTOR(S) : Dror Kella et al.

It is certified that error appears in the above-identified patent and that said Letters Patent is hereby corrected as shown below:

In The Claims

In column 11, line 24, in Claim 3, delete "drawn" and insert -- drawn from --, therefor.

Signed and Sealed this
Fourteenth Day of June, 2016

Michelle K. Lee

Michelle K. Lee
*Director of the United States Patent and Trademark Office*